United States Patent [19]

Blotenberg

[11] 4,384,818

[45] May 24, 1983

[54] METHOD AND APPARATUS FOR LIMITING THE END THRUST OF TURBO COMPRESSORS BY MEANS OF A BLOWOFF CONTROL

[75] Inventor: Wilfried Blotenberg, Oberhausen, Fed. Rep. of Germany

[73] Assignee: Gutehoffnungshütte Sterkrade Aktiengesellschaft, Fed. Rep. of Germany

[21] Appl. No.: 101,000

[22] Filed: Dec. 6, 1979

[30] Foreign Application Priority Data

Dec. 6, 1978 [DE] Fed. Rep. of Germany ..... 2852717

[51] Int. Cl.[3] ..... F04D 27/02

[52] U.S. Cl. ..... 415/1; 415/17; 415/27

[58] Field of Search ..... 415/1, 27, 15, 17, 28; 60/39.29

[56] References Cited

U.S. PATENT DOCUMENTS 4,139,328 2/1979 Kuper et al. ..... 415/27

FOREIGN PATENT DOCUMENTS 700687 12/1979 U.S.S.R. ..... 415/27

*Primary Examiner*—Louis J. Casaregola

*Attorney, Agent, or Firm*—McGlew and Tuttle

[57] ABSTRACT

A method of limiting the discharge pressure for turbo compressors by means of a blowoff control which is controlled by an anti-surge controller along with means for measuring the discharge pressure and an extreme value selector as well as means for measuring the pressure flow rate and for generating a signal from a manual controller, comprises, measuring the discharge pressure, comparing the measured pressure with a desired maximum pressure to produce a pressure control signal, measuring the compressor flow rate, comparing the measured flow rate with a minimum permissible flow rate to provide a flow rate control, directing a signal from a manual controller to the value selector to generate a manual controller signal and feeding each of the pressure control signal, flow rate control signal, and manual controller signal to the anti-surge controller to provide a control of the blowoff valve in accordance therewith.

3 Claims, 3 Drawing Figures

METHOD AND APPARATUS FOR LIMITING THE END THRUST OF TURBO COMPRESSORS BY MEANS OF A BLOWOFF CONTROL

FIELD AND BACKGROUND OF THE INVENTION

This invention relates to turbo compressors in general and, in particular, to a new and useful method and system of limiting the discharge pressure of compressors by means of a blowoff control, in which the pressure behind the compressor is measured and one or more blowoff valves, arranged behind the compressor, are actuated by a controller when the blowoff line in the pressure flow diagram or the set maximum pressure is reached.

A method of achieving discharge pressure limitations by means of blowoff control by limiting the actual flow rate is already known. This known method, however, is unsuitable in the presence of very steep blowoff lines because the desired value together with the control deviation changes only slightly through increased pressure. In addition, this method has the disadvantage that when limiting the actual value, the overall amplification of the control circuit is reduced, thereby causing the control to react more slowly. Shifting of the blowoff line with the temperature also shifts the desired value of the discharge pressure limitation. A pressure limitation by a horizontal blowoff line is not possible because no defined set point for flow rate is then associated with a particular discharge pressure so that control of the system becomes unstable.

SUMMARY OF THE INVENTION

The present invention provides a control method and an associated control system in which the prior art disadvantages are omitted and which, in particular, makes it possible to control the discharge pressure in a blowoff control system in a simple and effective manner, as well as safely and effectively when hard to control, steep blowoff lines are involved.

In a further development of the invention, other characteristics of compressor operation, such as, power (rating, performance, efficiency) mixing ratios, and the like have also been taken into consideration.

In accordance with the method of the invention, the discharge pressure in the compressor is limited by measuring the pressure at an end of the compresssor comparing that with a desired maximum pressure to produce a pressure control signal, measuring the compressor flow rate and comparing that with a minimum permissible flow rate to provide a flow rate control signal, directing a signal from a mechanical controller to the value controller to generate a manual controller signal, each of the pressure control signals and flow rate control signals being fed to the value selector in addition and actuating the proportional controller for the blowoff valve from the value selector in accordance with the signals fed thereto.

An object of the invention is to provide an apparatus for carrying out the method of the invention which includes means for measuring the discharge pressure and the value selector which is connected to the measuring means for the pressure as well as to measuring means for the controller and is employed to regulate a proportional controller for a blowoff valve so as to limit the discharge pressure in the compressor.

A further object of the present invention is to provide apparatus for limiting the discharge pressure of turbo compressors by means of a blowoff control which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
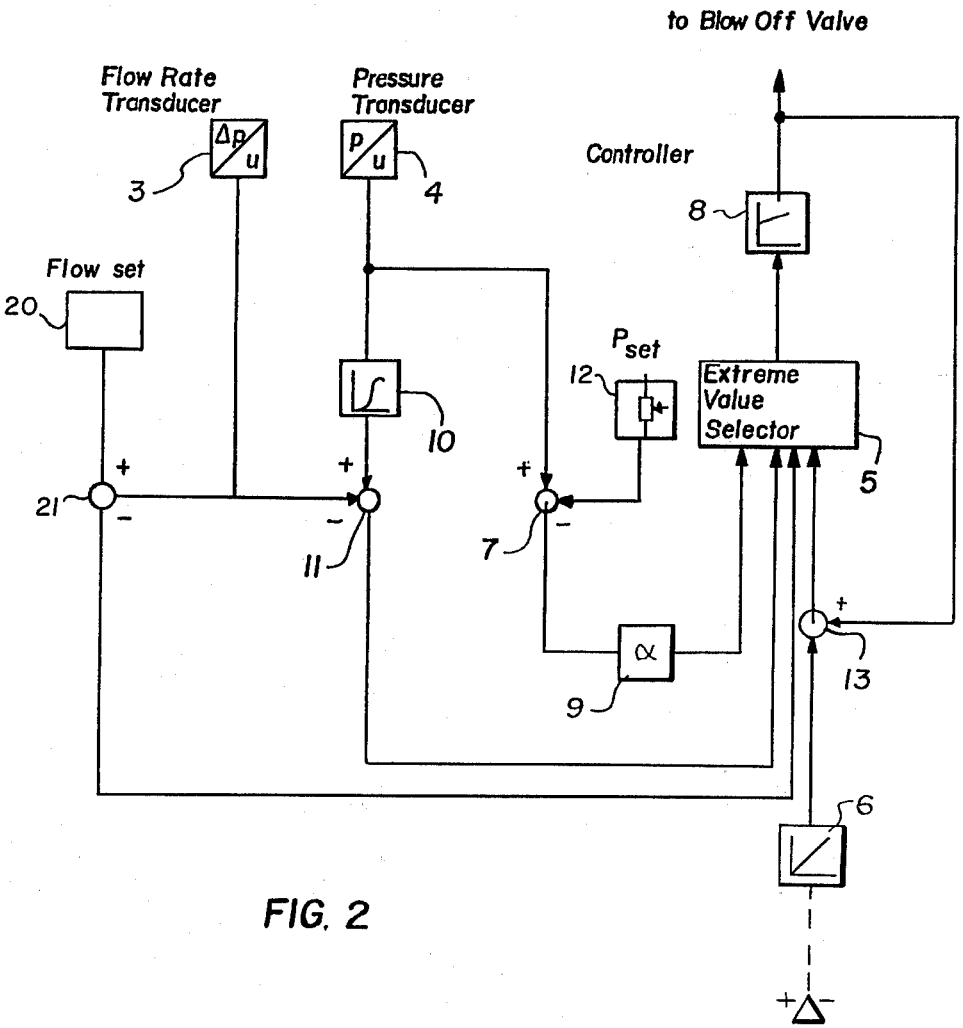
FIG. 2 is a schematic diagram of a blowoff line of a turbo machine of variable intake pressure having a vertical and horizontal branch.

Referring to the drawings in particular, the invention embodied therein, in accordance with FIG. 2, comprises, a method of limiting the discharge pressure $P_e$ in a compressor which has an anti-surge controller 8 as well as means for measuring the discharge pressure. In addition, there is a value selector 5 which is connected to the anti-surge controller 8. When the discharge pressure is measured, it is compared in the adder 7 with a desired maximum pressure (Pset) to produce a pressure control signal which is fed to the value selector 5.

Referring to FIG. 2, the discharge pressure measured in the limiting system is compared with the desired maximum pressure (Pset)) and fed to the extreme value selector 5 ahead of the controller 8, parallel to the control deviation. If required, this signal can be multiplied by a factor $\alpha$ in in a multiplication member 9 order to make an adaptation of the control amplifications possible, which are required for different operating modes.

The blowoff line will usually have a certain spacing from the surge line so as to have the required safety margin to prevent the turbo machine or turbo compressor from surging. In the usual manner, the control system according to FIG. 2 comprises a flow rate transducer and a pressure transducer measuring instrument 3 and 4, respectively, to measure the flow rate and the pressure which prevails behind the compressor. The signal of the pressure transducer 4 is transformed by a function generator 10 into a signal comparable with the signal of the flow rate transducer 3 and is compared with it. The difference, as coming from adder 11, between the two signals is then fed to the extreme value selector 5, from where the respectively greatest signal is fed to the controller 8 which, in turn, transmits the control signal for the blowoff valve, not shown.

It is essential for the invention that, in addition to the control circuit branch described, there be a second circuit in which the signal of the pressure transducer 4 is compared within adder 7 with a constant, variable signal coming from element 12 corresponding to the maximum highest or desired pressure (Pset). The difference of the signals is likewise fed to the extreme value selector 5.

In another branch of the control circuit, the controller signal is compared with a signal coming from a manual controller 6, with the signal difference likewise being fed to the extreme value selector 5. Accordingly, by the addition of simple supplemental components to the existing control system it is possible to set the maximum permissible discharge pressure effectively and reliably, as well as when hard to control blowoff lines are involved.

If the discharge pressure increases above the set permissible pressure, the controller 8 receives a positive control deviation, regardless of the distance of the operating point from the blowoff line, and opens the blowoff valve until the discharge pressure corresponds to the reference pressure. In order to make the required amplification conform to the set controller amplification, the fixed factor in the multiplication member 9 may be varied to suit the requirements. In addition, one advantage of the control system, according to the invention, consists in that a change in the position of the blowoff line has no effect whatever on the set desired maximum pressure.

Figure 1:
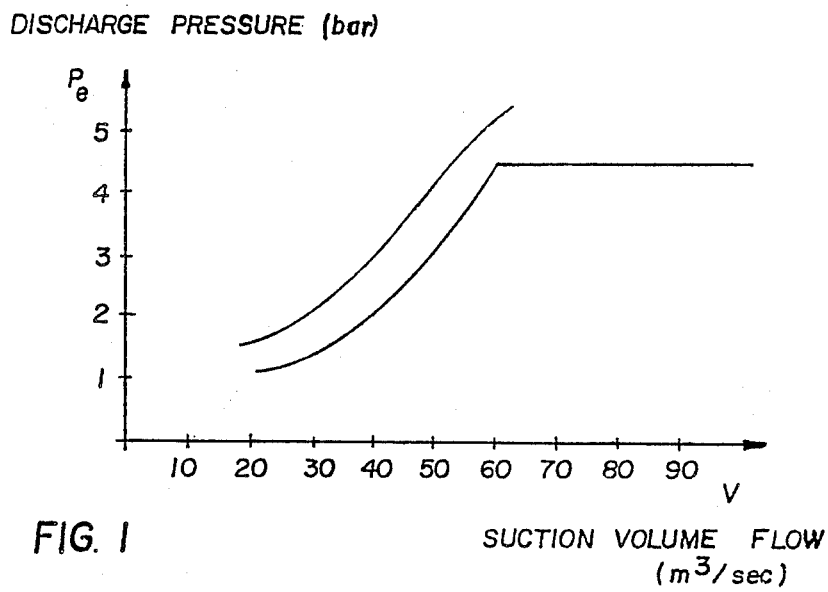
FIG. 1 is a curve showing a blowoff line and a surge line of a compressor.
Figure 3:
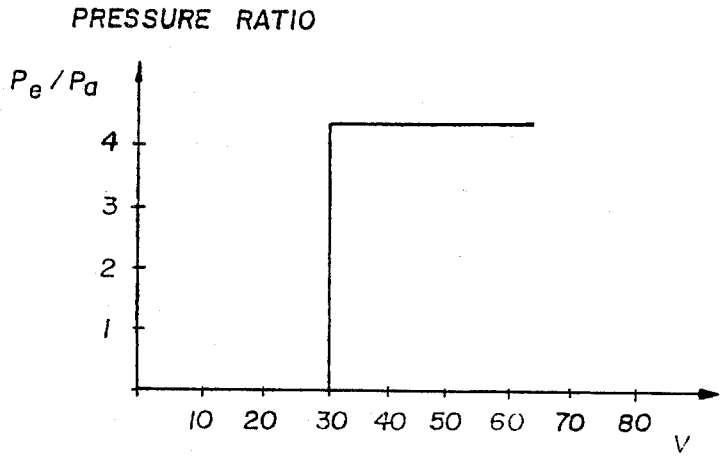
FIG. 3 is a curve, similar to FIG. 1.

Furthermore, in machines having a blowoff line, according to FIG. 3, the formation of the pressure ratio can be obviated when the method according to the invention is employed. Instead of the fixed maximum pressure, the intake pressure multiplied by the design pressure ratio is applied as the desired value, whereby, the horizontal branch is shifted toward small discharge pressures in accordance with the pressure ratio when the intake pressure drops, i.e. the maximum discharge pressure is adapted to the intake pressure.

In another embodiment of the invention, the drive power can also be determined and limited correspondingly. A control deviation resulting from the difference between actual power and maximum permissible power is formed therein, in accordance with the principle of the invention, and the differential power signal is fed to the extreme value selector 5, parallel to the other signals.

Generally, the method is also applicable to all other limitations, if the respective quantities such as flow rate, temperature, a mixing ratio and the like can be influenced in the desired direction by opening the blowoff valve. In this connection, several limitations may also be connected in parallel. As already mentioned above, the method according to the invention can also be expanded in a manner such that the maximum pressure for the limit control can be varied as a function of the intake pressure or other extraneous process quantities. As mentioned hereinbefore, the compressor flow rate can be measured in the flow rate transducer 3 and compared in adder 21 with a minimum permissible flow rate signal coming from element 20, and the resulting signal may be directed to the extreme value selector.

While a specific embodiment of the invention has been shown and described in detail to illustrate the application of the principles of the invention, it will be understood that the invention may be embodied otherwise without departing from such principles.

What is claimed is:

1. A method of limiting the discharge pressure of a compressor of the type having a blowoff valve, an anti-surge controller operatively connected to said blowoff valve, means for measuring the discharge pressure, said anti-surge controller being operable to generate an output signal for actuating blowoff, an extreme value selector connected to the anti-surge controller, a manual controller signal-producing device operatively connected to the value selector, and means for measuring the flow rate of the compressor, which comprises, comparing the measured pressure with a desired maximum pressure to produce a pressure control signal, supplying the pressure control signal to the extreme value selector, measuring the flow rate, comparing the measured flow rate with a minimum permissible flow rate to provide a flow rate control signal, supplying the flow rate control signal to the extreme value selector, actuating the manual controller to produce a manual signal, comparing the output signal of the controller with the manual signal to provide a manual-controller signal, directing the pressure control signal, the flow rate control signal and the manual-controller signal to the extreme value selector, and obtaining a control signal in the extreme value selector in accordance with the greatest of the signals being fed thereto for actuating the anti-surge controller.

2. A method, as claimed in claim 1, including measuring the intake pressure of the compressor and multiplying it by a design pressure ratio to provide a desired value, comparing the desired value with the measured pressure signal, and supplying the difference thereof to the extreme value selector.

3. A method, as set forth in claim 1 or 2, including the step of measuring the actual power, and comparing the actual power with a maximum permissible power to provide a power signal, and supplying the power signal to the extreme value selector.

* * * * *